US008747151B2

(12) United States Patent
Sutter

(10) Patent No.: US 8,747,151 B2
(45) Date of Patent: Jun. 10, 2014

(54) COAXIAL CABLE CONNECTOR HAVING A BODY WITH A FIRST INNER BORE DIAMETER NEAR A COUPLER AND A SECOND INNER BORE DIAMETER SMALLER THAN THE FIRST INNER BORE DIAMETER

(75) Inventor: Robert W. Sutter, DeKalb, IL (US)

(73) Assignee: Ideal Industries, Inc., Sycamore, IL (US)

( * ) Notice: Subject to any disclaimer, the term of this patent is extended or adjusted under 35 U.S.C. 154(b) by 23 days.

(21) Appl. No.: 13/540,866

(22) Filed: Jul. 3, 2012

(65) Prior Publication Data

US 2014/0011397 A1 Jan. 9, 2014

(51) Int. Cl.
*H01R 9/05* (2006.01)

(52) U.S. Cl.
USPC ..... 439/578

(58) Field of Classification Search
USPC ..... 439/578–585
See application file for complete search history.

(56) References Cited

U.S. PATENT DOCUMENTS

| | | | | |
|---|---|---|---|---|
| 5,007,861 | A | 4/1991 | Stirling | |
| 6,153,830 | A * | 11/2000 | Montena | 174/88 C |
| 6,790,081 | B2 * | 9/2004 | Burris et al. | 439/578 |
| 7,108,548 | B2 * | 9/2006 | Burris et al. | 439/578 |
| 7,828,595 | B2 | 11/2010 | Mathews | |
| 7,942,695 | B1 | 5/2011 | Lu | |
| 7,976,339 | B2 | 7/2011 | Buck et al. | |
| 8,011,955 | B1 | 9/2011 | Lu | |
| 8,137,132 | B2 | 3/2012 | Lu | |
| 8,157,589 | B2 * | 4/2012 | Krenceski et al. | 439/578 |
| 8,172,612 | B2 | 5/2012 | Bence et al. | |
| 8,382,517 | B2 * | 2/2013 | Mathews | 439/578 |
| 8,480,431 | B2 * | 7/2013 | Ehret et al. | 439/578 |
| 2011/0201231 | A1 | 8/2011 | Lu | |
| 2011/0263153 | A1 | 10/2011 | Lu | |

OTHER PUBLICATIONS

AMPEC Innovations, Inc:, ASP-59/59Q/6/6Q, printout from web site, http://www.ampecinc.com/telecom/products4.php?sn=864EtLk=2, 2012, 1 page.

ISA/US, International Search Report and Written Opinion issued on PCT Application No. US13/48947, 9 pages.

* cited by examiner

*Primary Examiner* — Chandrika Prasad
(74) *Attorney, Agent, or Firm* — Greenberg Traurig, LLP

(57) ABSTRACT

A connector for a coaxial cable includes a mandrel, a coupler, and a body. The mandrel is insertable between the dielectric and the outer conductor of the cable. The coupler includes an annular shoulder extending radially inward from the coupler for retaining a mandrel. The body is matingly engaged with the coupler and defines a first inner bore proximate the coupler having a substantially coextensive diameter and a second inner bore having a diameter smaller than the first inner bore. Together, the mandrel sleeve and the second inner bore squeeze the outer jacket of the coaxial cable between the outer surface of the mandrel sleeve and the second inner bore to affix the connector to the cable.

17 Claims, 11 Drawing Sheets

COAXIAL CABLE CONNECTOR HAVING A BODY WITH A FIRST INNER BORE DIAMETER NEAR A COUPLER AND A SECOND INNER BORE DIAMETER SMALLER THAN THE FIRST INNER BORE DIAMETER

FIELD OF THE DISCLOSURE

The present disclosure relates generally to coaxial cable connectors and more particularly to coaxial cable connectors and methods of manufacturing the same.

BACKGROUND OF RELATED ART

Coaxial cable connectors are known in the art. In general a coaxial cable connector, such as for example an F-connector, is commonly used for "over the air" terrestrial television, cable television, and universally for satellite television and cable modems, usually with RG-6 cable or, in older installations, with RG-59 cable. Coaxial cables typically include a center or inner conductor surrounded by a dielectric or core, in turn surrounded by an outer conductor or shield, which in turn is surrounded by an outer insulator otherwise known as a jacket. A coaxial cable connector is secured over the prepared end of the jacketed coaxial cable, allowing the end of the coaxial cable to be connected with a terminal block.

For example, U.S. Pat. No. 5,007,861 describes a crimpless coaxial cable connector that can be secured to a cable simply by pushing the cable into the connector and subsequently pulling it back. The body of the connector has a bushing mounted within it near the cable receiving end having a diameter to closely receive the cable. The body of the connector also has within it an annular mandrel having a bore to receive the stripped core of the cable, and having a sleeve adapted to engage the cable beneath the jacket by pushing the cable and the mandrel together. This stretches the jacket of the cable to a diameter greater than the internal diameter of the bushing. The mandrel is movable from a position in which the sleeve is surrounded by the bushing in which the sleeve may be engaged to the cable, to a position in which the sleeve is at least partially within the bushing in which the jacket is frictionally engaged by the bushing, by pulling the cable away from the connector after it has been pushed onto the mandrel sleeve.

U.S. Pat. No. 6,790,081 generally describes a coaxial cable connector including a coupler, a post, and a body member. One end of the body member includes a lip that is inserted through the opening in an annular collar of the coupler. In a cable-installed position, the shank of the post is received in the body member to form an annular chamber which is sufficiently narrow to compress the outer conductor and the jacket of a coaxial cable to establish a distal seal. Tightening of the coupler to the terminal compresses the lip between the flange of the post and the annular collar for establishing a proximal seal.

U.S. Pat. No. 7,942,695 describes a cable end connector includes a tubular connection member having a coupling portion, a core tube having a stop flange mounted in the coupling portion, a barbed flange and a coupling portion. A plastic outer tubular member having a front tubular coupling portion coupled to the coupling portion, a rear tubular body and an annular packing portion for engaging the coupling portion of the core tube, a retaining sleeve fastened to the rear tubular body, and an insulative holder block mounted in the core tube to hold a metal center pin for the connection of the center conductor of a coaxial cable.

Finally, U.S. Pat. No. 8,172,612 describes a coaxial cable connector includes tubular post, a coupler secured over an end of the tubular post for securing the connector to an appliance, and an outer body secured to the tubular post. An electrical grounding path is maintained between the coupler and the tubular post whether or not the coupler is tightly fastened to the appliance. The electrical grounding path is provided by a resilient, electrically-conductive grounding member disposed between the tubular post and the coupler.

While the above referenced connectors generally work for their intended purposes, there is an identifiable need for manufacturing, assembly, design, and/or cost improvements as described by the connector disclosed. In particular, the presently disclosed connectors and methods of manufacturing the same provide for an efficient connector while allowing enhanced manufacturing techniques to provide an oftentimes simplified assembly process.

DETAILED DESCRIPTION

The following description of example methods and apparatus is not intended to limit the scope of the description to the precise form or forms detailed herein. Instead the following description is intended to be illustrative so that others may follow its teachings.

Figure 1A:
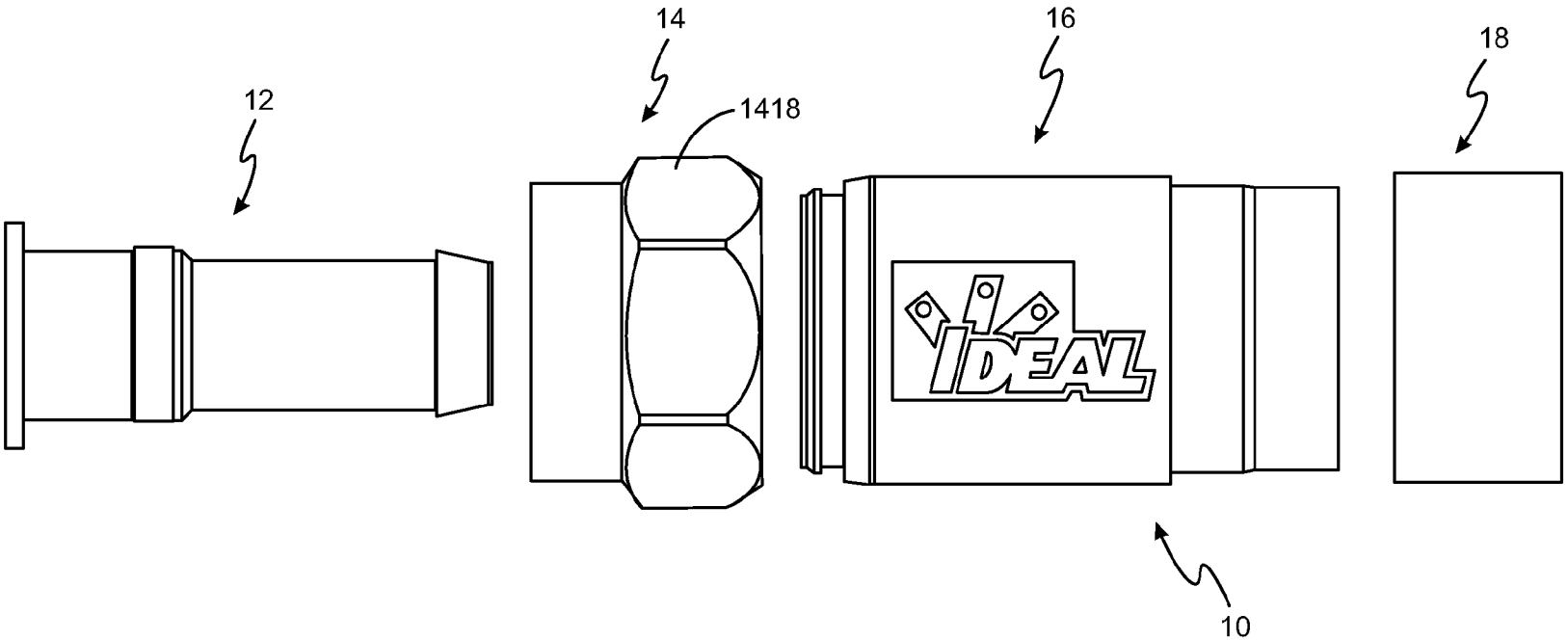
FIG. 1A is an exploded side view of an example coaxial cable connector of the present disclosure.
Figure 1B:
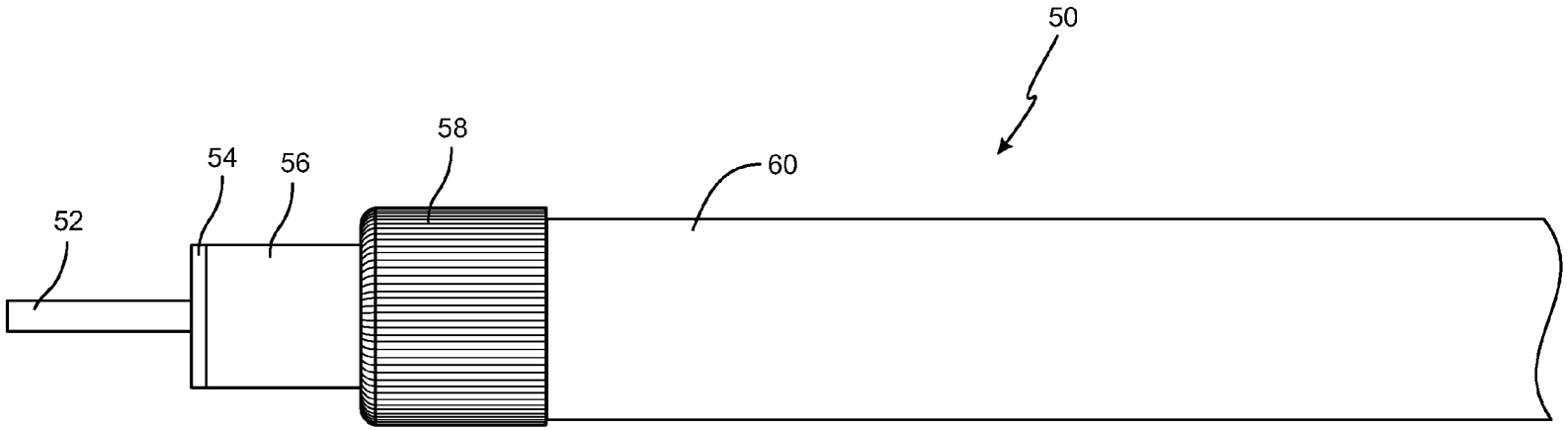
FIG. 1B is a side view of an example coaxial cable for use with the example connector of FIG. 1.

Referring now to the figures, and more particularly to FIGS. 1A and 1B, an example of a connector 10 for a coaxial cable 50 is illustrated. The example coaxial cable 50 comprises a central conductor 52, a dielectric insulator 54 with, in some instances, a foil cover 56, an outer conductor or shield layer such as a braided shield 58, and a plastic jacket 60. It will be appreciated that the illustrated cable 50 in FIG. 1 has been stripped and prepared via any coaxial cable preparation technique suitable for use with the connector 10.

For securing over the prepared end of the jacketed coaxial cable 50, to allow the end of the coaxial cable 50 to be connected with a standard terminal block (not shown), the example connector 10 comprises a mandrel 12, a coupler in the form of a threaded nut 14, a body 16, and an optional retaining sleeve 18. As will be described in greater detail, the example connector 10 is adapted to receive the cable 50 and to tightly hold the cable 50 by inserting a prepared cable 50 and moving (e.g. compressing) the mandrel 12 relative to the body 16.

Each of the mandrel 12, nut 14, body 16, and retaining sleeve 18 may be made of the same or different materials from each other. It will be appreciated that the example connector 10 forms a conductive path between the braided shield 58 and the outer surface of the terminal (not shown). For instance, in this example, the mandrel 12, nut 14, and retaining sleeve 18 comprise a metallic, conductive material, such as brass or plated brass. In this example, the body 16 is comprised of a material different from that of the nut 14 and mandrel 12, such as for example, a non-conductive flexible and/or semi-flexible plastic material. The nut 14, mandrel 12, and retaining sleeve 18 may be manufactured by any suitable manufacturing means including, for example machining from bar stock on automatic screw machines known in the industry. Meanwhile, because of the inner and outer geometry of the example body 16, the body 16 may similarly be manufacturing via any suitable technique, including for example, injection molding, wherein the manufacturing process does not require any undercutting and/or additional manufacturing process to form the body 16.

Figure 2:
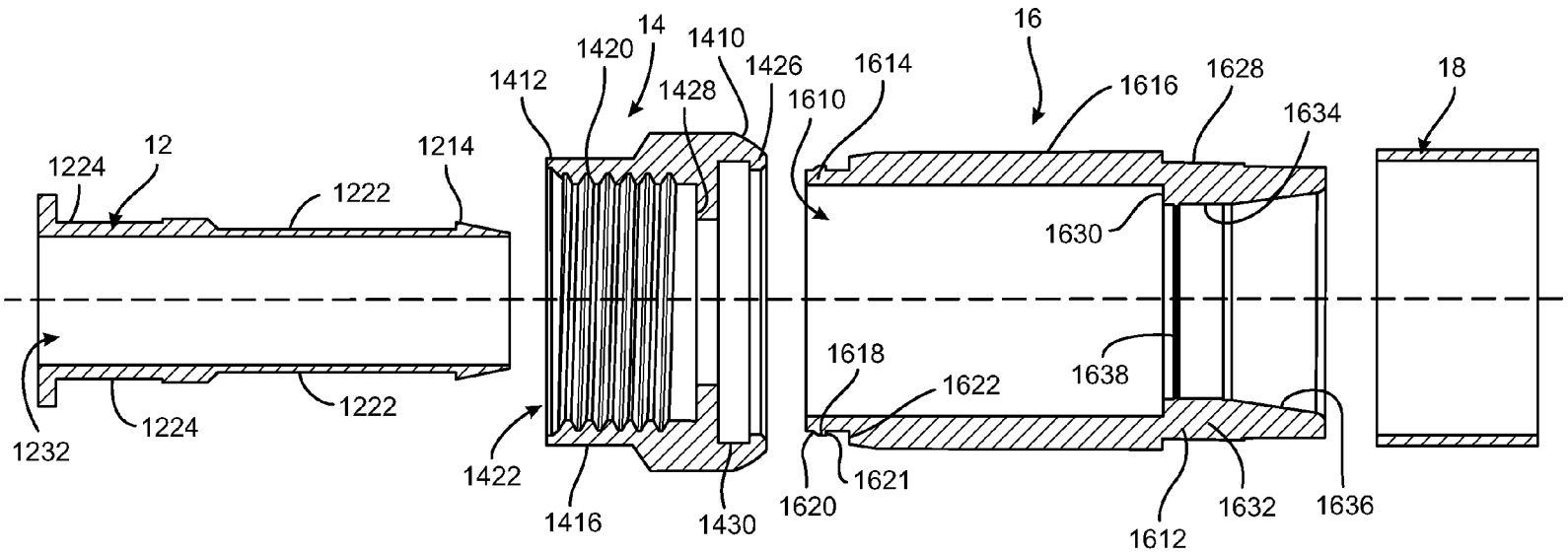
FIG. 2 is an exploded cross-sectional side view of the example coaxial cable connector of FIG. 1.
Figure 3:
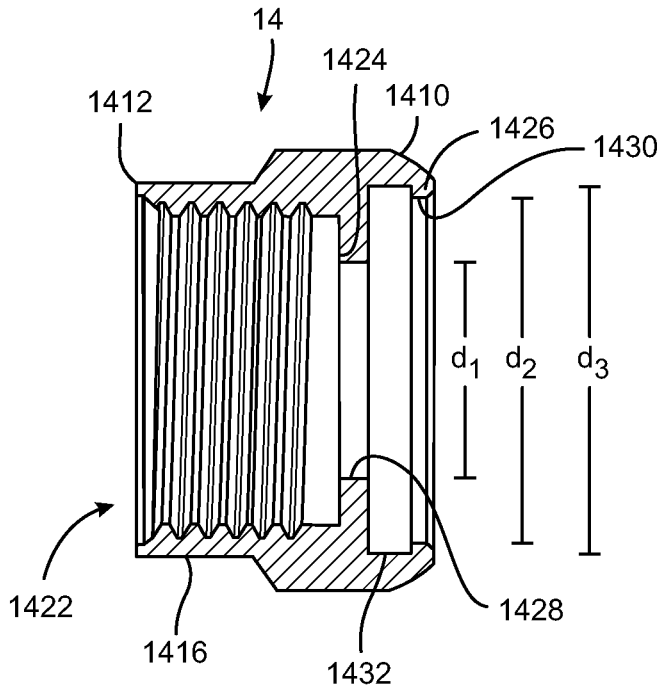
FIG. 3 is a cross-sectional side view of an example coupler for use with the example coaxial cable connector of FIG. 1.

Referring to FIG. 2 and FIG. 3, in this example, the nut 14 comprises a distal nut end 1410, and a proximal nut end 1412 situated forward of the distal nut end 1410. A substantially cylindrical portion 1416 extends between the distal nut end 1410 and the proximal nut end 1412. In this example, the outer surface of the substantially cylindrical portion 1416 defines a hexagonal or other polygonal outer surface 1418 (FIG. 1), such as found with known nuts. Additionally, for securing the nut 14 onto a male terminal (not shown) the nut 14 has an internal surface 1420 defining a female port 1422. The internal surface 1420 of the nut 14 may be threaded for tightening to the male terminal, which may be correspondingly threaded to accept the internal threads of the nut 14.

The example nut 14 further comprises an annular shoulder 1424 and an annular lip 1426. The disclosed annular shoulder 1424 is situated rearward relative to the female port 1422 and extends radially inward from the substantially cylindrical portion 1416 to provide a collar opening 1428 having an opening diameter $d_1$. The disclosed annular lip 1426 is situated rearward relative to the annular shoulder 1424 and extends radially inward from the substantially cylindrical portion 1416 to provide an opening 1430 having an opening diameter $d_2$, greater than the opening diameter $d_1$. Together the example annular shoulder 1424 and the annular lip 1426 define a substantially u-shaped channel 1432 therebetween and having a channel diameter $d_3$ for retaining the body 16 as disclosed herein.

Figure 4:
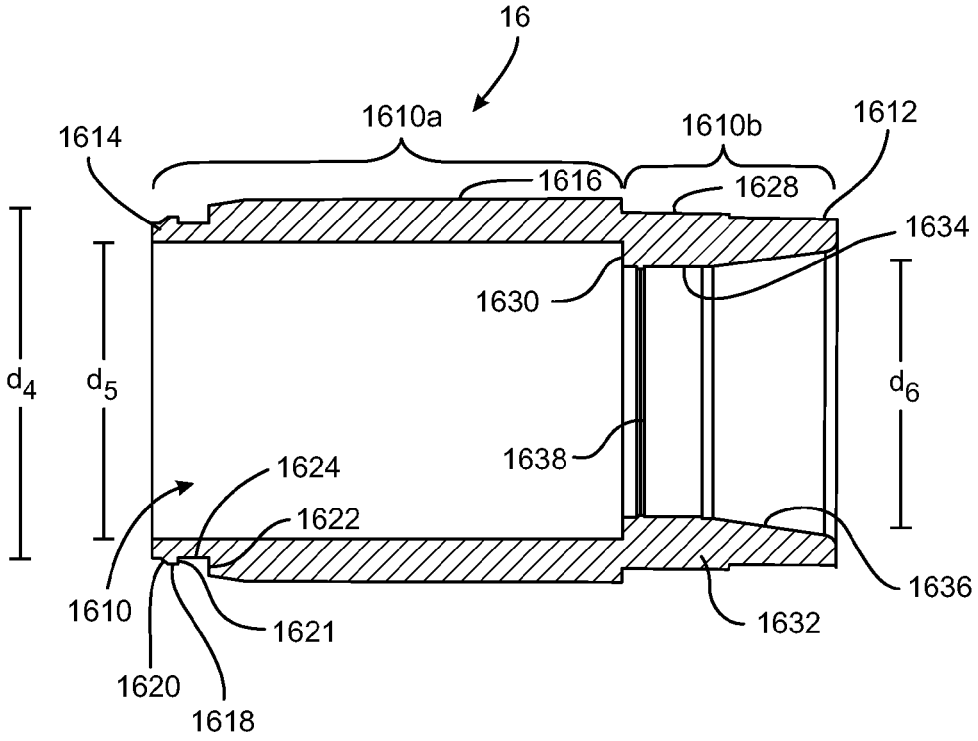
FIG. 4 is a cross-sectional side view of an example body for use with the example coaxial cable connector of FIG. 1.

As shown in FIGS. 2 and 4, for retaining the cable 50, the example body 16 defines a central passageway 1610, a distal body end 1612, and a proximal body end 1614 situated forward of the distal body end 1612. The example body 16 further comprises a proximal body section 1616 comprising an annular lip 1618 located at and/or near the proximal body end 1614. The disclosed annular lip 1618 extends radially outward from the proximal body end 1614 to provide an outer diameter $d_4$ that is greater than the opening diameter $d_2$ defined by the annular lip 1426 of the nut 14 and substantially similar to the channel diameter $d_3$. The central passageway 1610 defined by the proximal body section 1616 has an opening diameter $d_5$. In this example, the opening diameter $d_5$ is substantially coextensive (e.g. the same) along the entire length of the passageway 1610 under the proximal body section 1616, e.g., the entire length from the proximal body end 1614 to the end of the proximal body section 1616 defined by an interior shoulder described herein. In some examples, while the opening diameter $d_5$ is substantially coextensive, the diameter may converge slightly from the proximal body end 1614 toward the end of the proximal body section 1616, while still avoiding any undercuts and allowing for the described manufacturing techniques. Still further, it will be appreciated by one of ordinary skill in the art that in some instances and/or materials, the opening diameter $d_5$ may be created with an slight undercut that, while still being substantially coextensive, is nevertheless very slightly undercut and/or divergent. In these example, the undercut must be sufficiently small such that the diameter is substantially coextensive and/or convergent under the doctrine of equivalents, while allowing for the manufacturing techniques described herein.

Returning to the exterior of the body 16, the example lip 1618 may be formed as an integral or unitary piece with the outer surface of the body 16. Still further, as previously indicated, the body 16, and thus the lip 1618 may comprise a non-conductive flexible, non-flexible, and/or semi-flexible, plastic material such as an elastically deformable material possessing "memory" and/or a plastically deformable material having limited "memory." The lip 1618 may also comprise any suitable material and/or be configured to be partially deformable and/or partially elastic as desired.

In this instance, the example lip 1618 has a radius and/or a forward chamfer 1620 for facilitating insertion of the lip 1618 through the opening 1430 of the nut 14 and a non-radiused and/or non-chamfered surface 1621 (e.g., a shoulder) to assist in the prevention of removal of the lip 1618 from he nut 14 once inserted through the opening 1430. Additionally, the example body 16 includes an external defined annular shoulder 1622 situated rearward relative to the lip 1618 to define a channel 1624 to retain the annular lip 1426 when assembled. As will be appreciated, the dimension of the channel 1624 may allow for the free rotation of the nut 14 about the outer surface of the body 16 when the two are properly assembled to aid in the connection of the nut 14 to the terminal (not shown).

In some examples, including the example connector 10 illustrated, the exterior of the example body 16 may include an outer channel 1628 to provide a mating location for the retaining sleeve 18 if present. The retaining sleeve 18 may be optionally located over the body 16 to provide additional protection against deformation of the body 16 when in use, and as such may be replaced and/or omitted as desired.

Located in the body 16, and more particularly in the central opening 1610, is an interior annular shoulder 1630 having an opening diameter $d_6$ separating the proximal body section 1616 from a distal body section 1632. In the illustrated example, the proximal body section 1616 and the distal body section 1632 are each cylindrical, although the distal body section 1632 has a inner surface opening 1634 with a diameter $d_6$ that is smaller than the diameter $d_5$ of the proximal body section 1616. As such, in this instance, the defined central opening 1610 comprises a first inner bore, e.g., a first opening section 1610*a* defined by the proximal body section 1616 having a substantially coextensive diameter, and a second inner bore, e.g., a second opening section 1610*b* defined by the distal body section 1632 having a convergent diameter. Thus, the entirety of the example central opening 1610 of the body 16 does not have any undercuts. This lack of undercut greatly decreases the complexity required to manufacture the body 16.

The distal body section 1632 extends axially away from the proximal body section 1616 and the example inner surface 1634 includes a tapered or indented inner surface portion comprising a tapering region 1636 that tapers radially inward in a direction towards the interior annular shoulder 1630 and the proximal body section 1616. As will be described, when assembled, the inner surface 1634 defines a cable jacket sealing surface region that seals and retains the cable jacket 60 between the inner surface 1634 and the mandrel 12. In this example, the inner surface also includes an annular lip 1638 to assist in the retention and sealing of the cable jacket 60.

Figure 11:
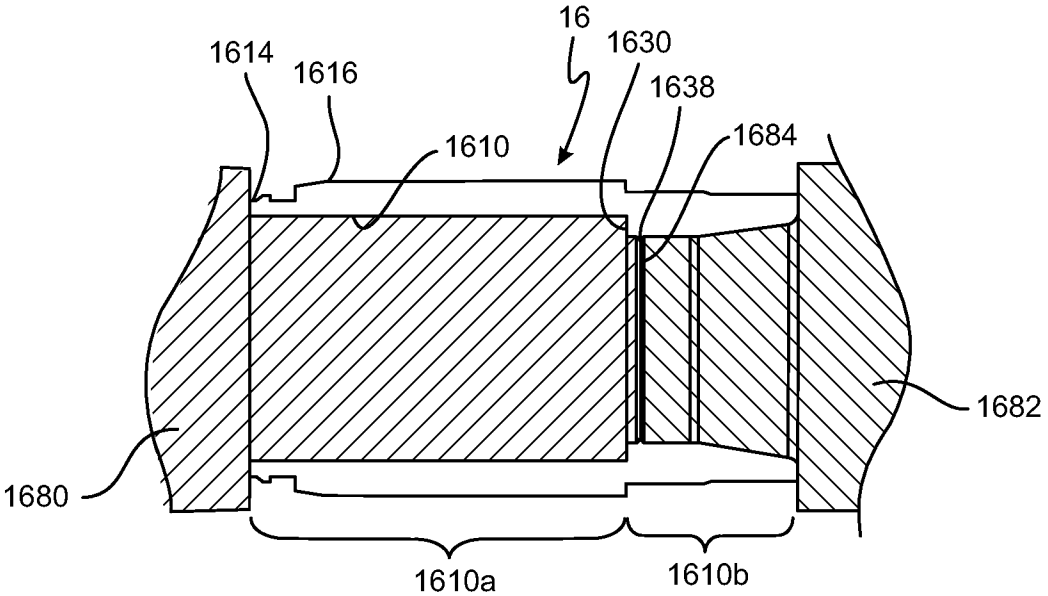
FIG. 11 is a cross-sectional side view of the example body of the coaxial cable connector of FIG. 1 showing an example injection molding process for forming the body.

For forming the body 16, as illustrated in FIG. 11, the body 16 may be injection molded without requiring additional manufacturing typically necessary to form undercuts in a central passageway. In the illustrated example, the inner bore of the body (e.g., the central passage 1610) is formed through the use of a two core pin injection mold process. In particular, the example process includes a first core pin 1680 and a second core pin 1682, meeting at an interference line 1684. In this instance, the first core pin 1680 forms the entirety of the first opening section 1610*a* and a portion of the second opening section 1610*b* to the annular lip 1638. Meanwhile the second core pin 1682 forms the remaining portion of the second opening section 1610*b* from the annular lip 1638 to the distal body end 1612. In this instance, the interface 1684 of the first and second core pins 1680, 1682, is shaped to form the annular lip 1638. It will be appreciated, however, that where the annular lip 1638 is not present in the connector 10, the interface 1684 between the core pins 1680, 1682 may be moved and/or otherwise located in the central opening 1610 as desired. In will further be appreciated that while the example first opening section 1610*a* is illustrated as including a substantially coextensive diameter, the first opening section 1610*a* may include one or more divergent diameter opening portions, such as a chamfered end located near the proximal body end 1614, without requiring the formation of any undercut therein, thus allowing for simplified molding as herein described.

Figure 5:
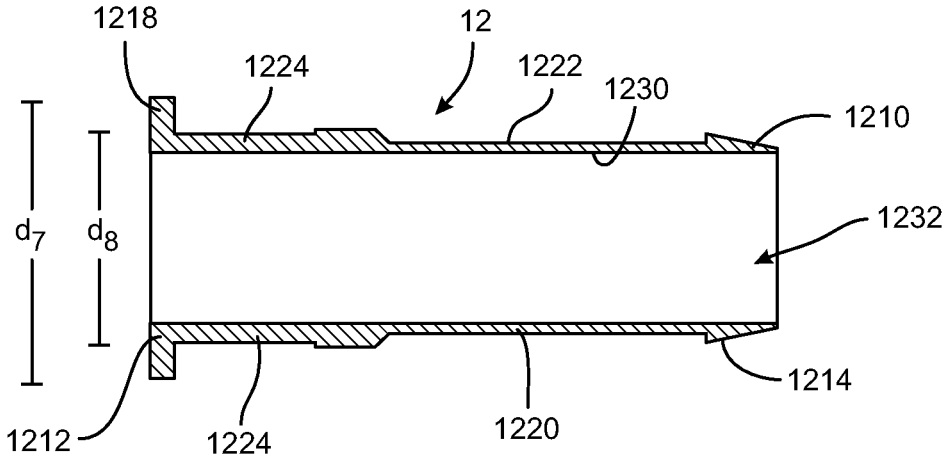
FIG. 5 is a cross-sectional side view of an example mandrel for use with the example coaxial cable connector of FIG. 1.

Now referring more particularly to FIGS. 2 and 5, for sealing and retaining the cable 50 in the connector 10, the mandrel 12 comprises a distal mandrel end 1210, and a proximal mandrel end 1212 situated forward of the distal mandrel end 1210. The distal mandrel end 1210 terminates at an annular barb 1214 to assist in the retention and sealing of the cable 50 against the body 16 when assembled. The mandrel 12 further comprises a radially extending mandrel flange 1218 having an outer diameter $d_7$ that is greater than the opening diameter $d_1$ to prevent the mandrel flange 1218 from passing through the opening $d_1$. A mandrel sleeve 1220 extends between the distal mandrel end 1210 and the proximal mandrel end 1212. The mandrel sleeve 1220 may, in at least one example, have an outer surface 1222 having at least one elevated portion 1224. The example elevated portion has an outer diameter $d_8$ that, in this example, is essentially the same as the opening diameter $d_1$ to provide an interference engagement (e.g., a friction-fit) between the mandrel 12 and the nut 14. An inner surface 1230 of the mandrel sleeve 1220 defines a central bore 1232. The outer diameter $d_8$ of the elevated portion is preferably smaller proximate the flange 1218 to release he interference engagement of the mandrel 12 and the nut 14 once the mandrel 12 is sufficiently moved (e.g. compressed) into the connector 10, as described herein, to allow the free rotation of the nut 14 relative to the mandrel 12 as desired.

It will be understood, however, that in at least some instances, the mandrel 12 may not include an elevated portion 1224 and as such the nut 14 and the mandrel 12 may not be interferencely engaged, but rather the two components may be free to slide and/or otherwise move (e.g., rotate) relative to one another as desired. In this instance, the connector 10 may be considered a push-on connector as opposed to a compression-fit connector.

Figure 6:
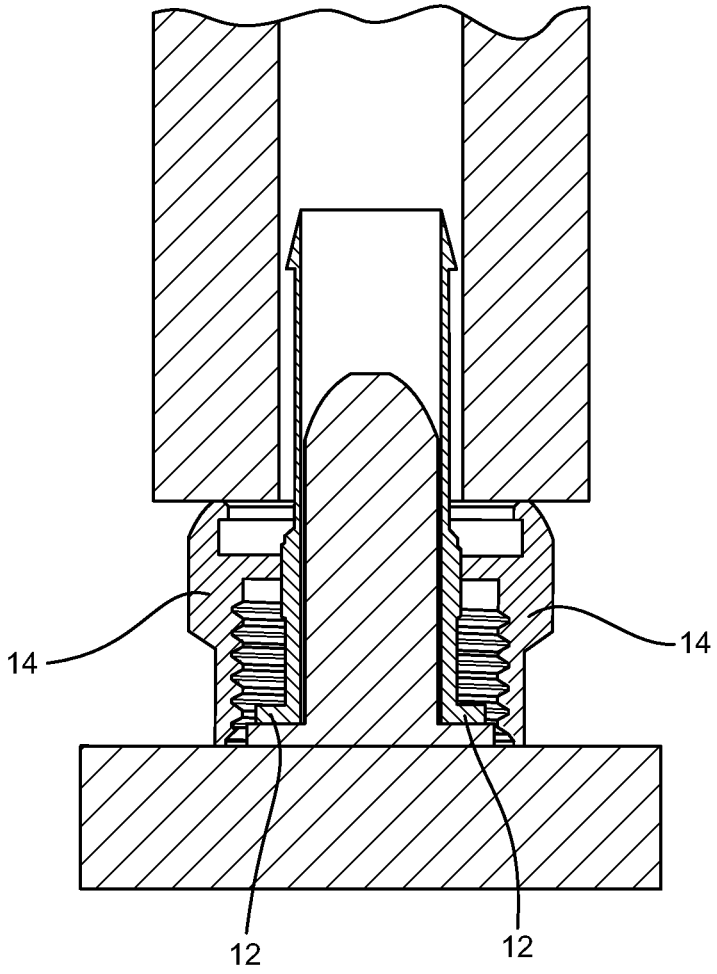
FIGS. 6 and 7A-7B together illustrate an example assembly method for assembling the example coaxial cable connector of FIG. 1.
Figure 7A:
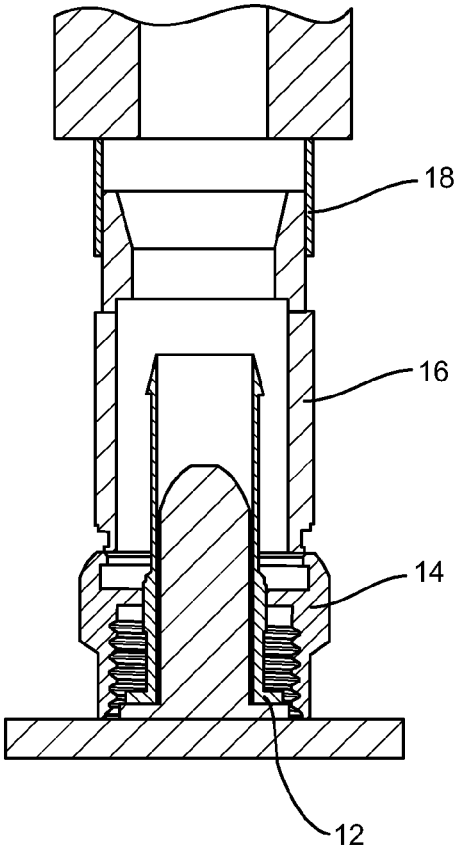
Figure 7B:
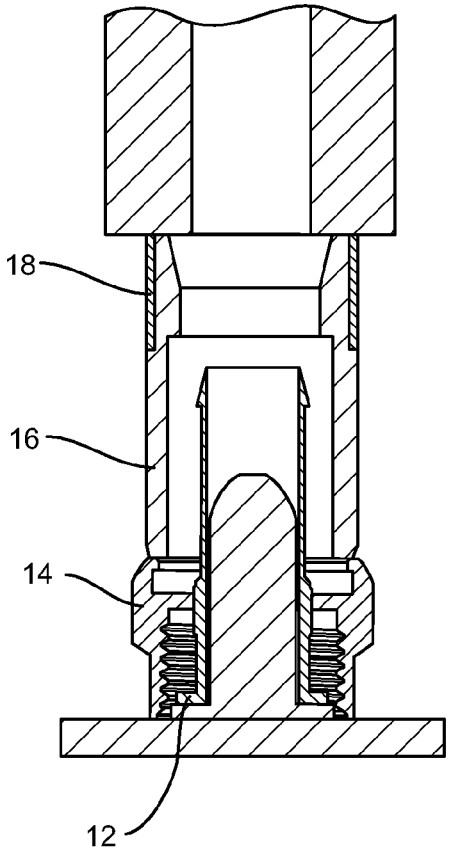

Referring now to FIGS. 6, 7A and 7B, a method for assembling the connector 10 is illustrated. Specifically, as shown in FIG. 6, the example assembly method comprises pressing the mandrel 12 and the nut 14 together so that the elevated portion 1224 is retained by the annular shoulder 1428. As shown in FIGS. 7A and 7B, the same press may then be used to press the body 16 onto the nut 14 and to press the retaining sleeve 18 onto the body 16. For instance, the example method presses the body 16 and the nut 14 together so that the annular lip 1618 of the body 16 is inserted through the opening diameter $d_2$ defined by the annular lip 1426 of the nut 14. Similarly, the example method presses the retaining sleeve 18 over the outer channel 1628 so that the retaining sleeve 18 is engaged and retained by the body 16. As previously noted, the retaining sleeve 18 may be provided to prevent outward deformation of the distal body end 1612 when the connector 10 is in use.

Also as previously noted, the body 16 or at least a portion thereof, such as the annular lip 1618 and/or the proximal body section 1616 may be made of a material that is sufficiently flexible to permit the annular lip 1618 to be flexed radially inward to fit through the smaller diameter $d_2$ of the opening 1430 formed by the annular lip 1426. The forward chamfer 1620 of the lip 1618 may help to facilitate insertion of the lip 1618 through the opening 1430. The lip 1426 is thereby placed into a surrounding relationship with the proximal body section 1616 of the body 16. Axially, the lip 1426 is disposed between the surface 1621 and the annular shoulder 1622 of the body 16. As illustrated, the tolerance between the nut 14 and the body 16 provides for an axial spacing to permit limited axial movement of the nut 14 in the channel 1624. As a consequence, the nut 14 (and the retained mandrel 12) is rotatably engaged to the proximal body section 1616. Free-spinning movement of the nut 14 relative to the body 16 is thereby permitted, at least until the nut 14 is threadably tightened onto the threaded terminal.

It will be appreciated that while the manufacturing process described herein is illustrated as a two-step process, the manufacturing of the example connector 10 may be performed in any number of steps, and in any suitable order as desired. For example, the entire connector 10 may be assembled as a single process, or alternatively, portions of the connector 10 may be assembled prior to (e.g. pre-assembled) the described process.

Figure 8:
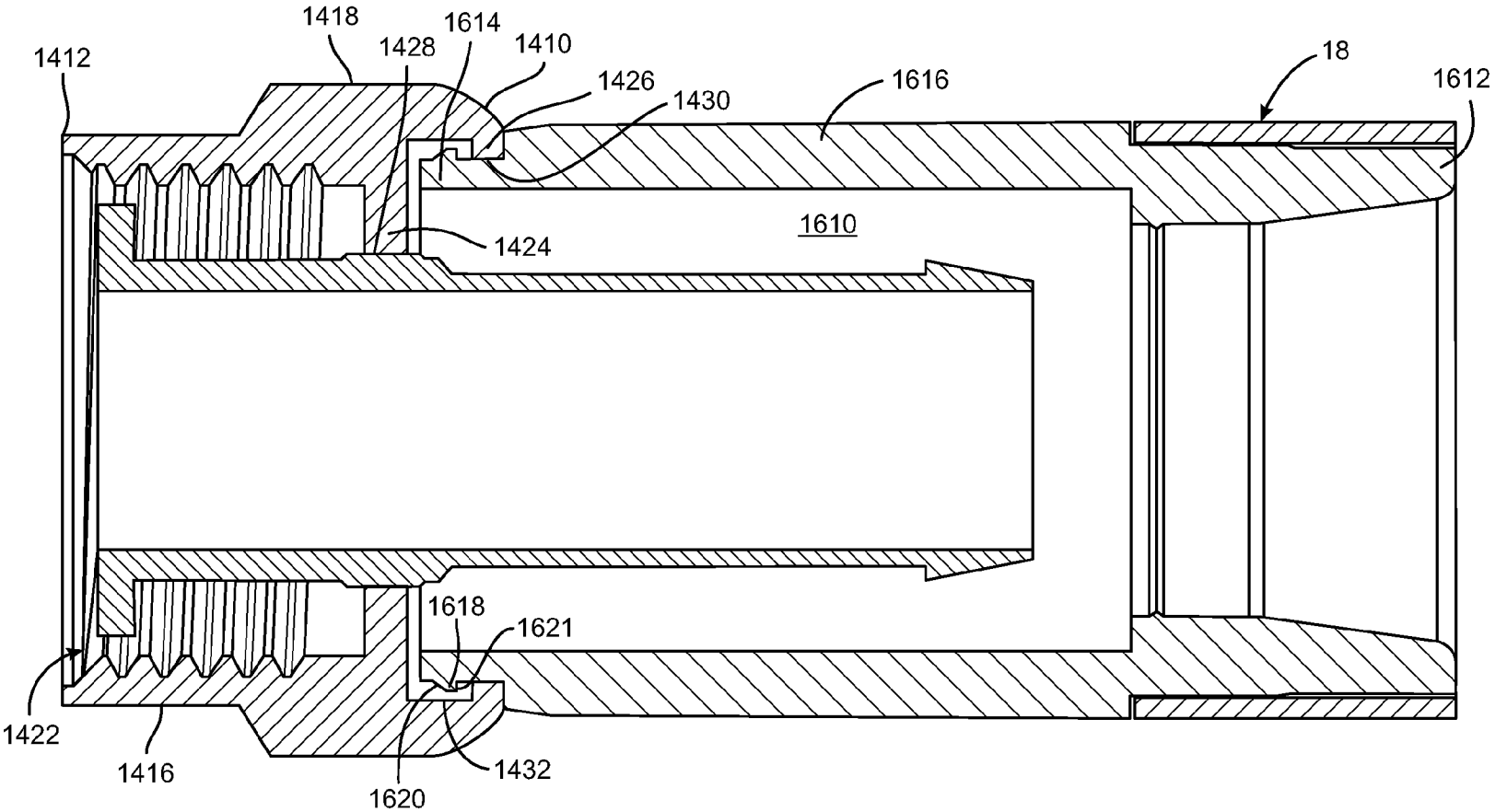
FIG. 8 is a cross-sectional side view of the assembled example coaxial cable connector of FIG. 1 showing the connector prior to compression and prior to cable insertion.

A cross-sectional view of the assembled connector prior to retention of the cable 50 is illustrated in FIG. 8.

Figure 9:
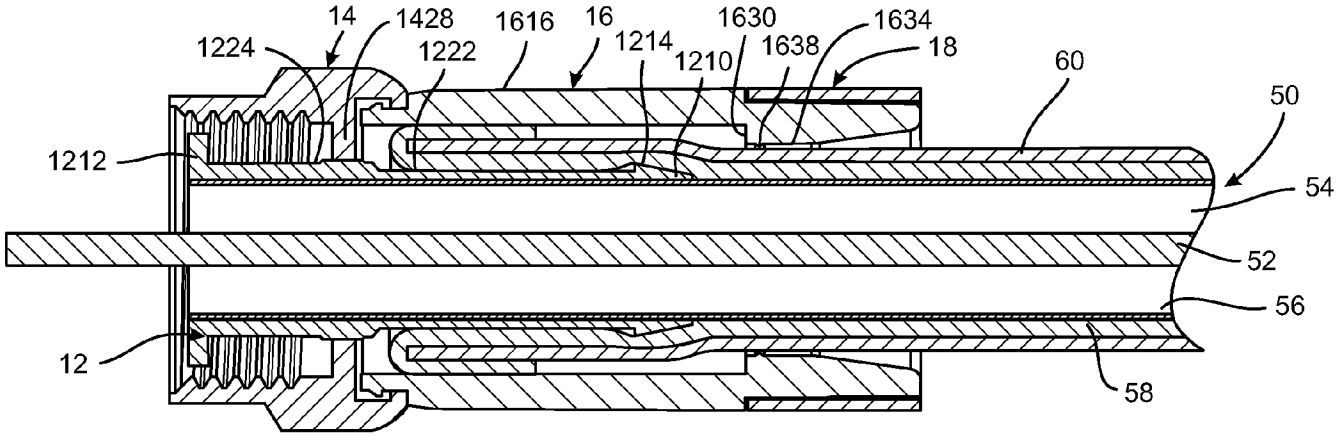
FIG. 9 is a cross-sectional side view of the assembled example coaxial cable connector of FIG. 1 showing the connector prior to compression and after cable insertion.
Figure 10:
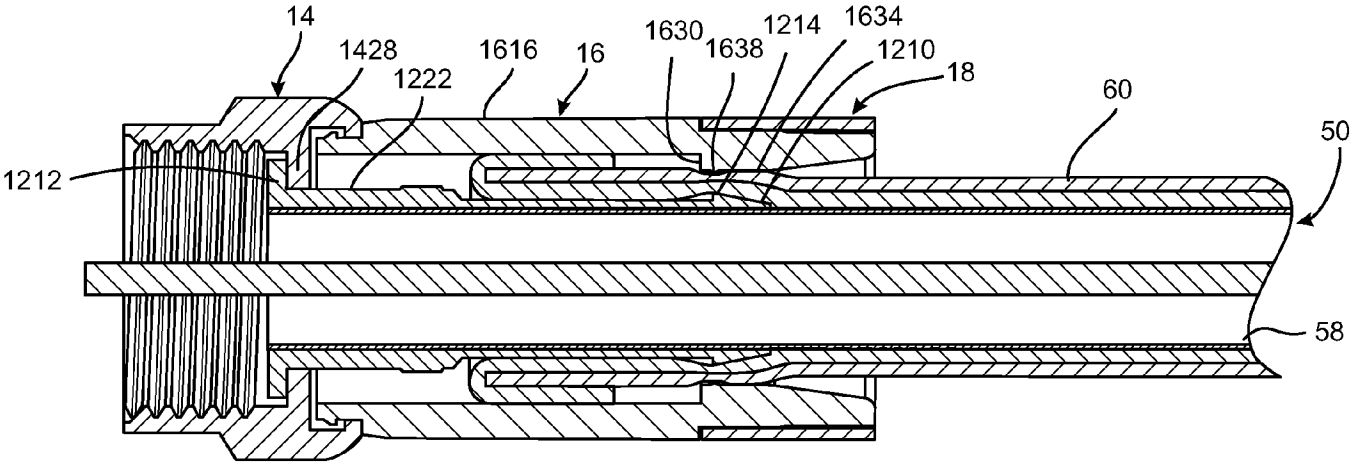
FIG. 10 is a cross-sectional side view of the assembled example coaxial cable connector of FIG. 1 showing the connector after compression and after cable insertion.

Turning now to FIGS. 9 and 10, an example method of engaging the connector 10 with the coaxial cable 50 will be described in further detail. In the illustrated example, the end of coaxial cable 50 preferably is advanced into connector 10. As illustrated at least a portion of the cable 50 extends through the central bore 1232 of the mandrel 12, the female port 1422 of the nut 14, and the central passageway 1610 of the body 16 from the distal body end 1612 towards the proximal body end 1614. As the cable 50 is inserted into the connector 10, the distal mandrel end 1210 and the mandrel sleeve 1220 are inserted between the dielectric insulator 54 and the braided shield 58 as illustrated in FIG. 9. Insertion of the cable 50 into the connector 10 can be accomplished, for example, using any industry standard assembly tool and/or may be accomplished simply by pushing the cable 50 into the connector 10 by hand. Furthermore, as illustrated, upon pushing the cable 50 into the connector 10, the mandrel sleeve 1220 is inserted between the braided shield 58 and the dielectric insulator 54, while the central conductor 52, the dielectric insulator 54, and the foil cover 56 are received within the central bore 1232 of the mandrel 12.

After insertion of the cable 50 into the connector 10 as shown in FIG. 9, the mandrel 12 then is moved axially rearward (e.g., compressed and/or freely moved) relative to the nut 14 and the body 16 into the cable-installed position shown in FIG. 10. This may be performed with any suitable action, including for example, the use of an industry standard compression tool. In moving toward the cable-installed position, the mandrel flange 1218 is advanced axially rearward within the nut 14 to place the mandrel flange 1218 in close proximity to and/or abutting relationship with the annular shoulder 1424 of the nut 14. The mandrel sleeve 1220 is sufficient in length to extend to the interior annular shoulder 1630 of the body 16, and more particularly to the inner surface opening 1634 and the annular lip 1638.

As shown from a comparison of FIG. 9 and FIG. 10, as the mandrel sleeve 1220 is moved from the cable-insertion position rearward to the cable-installed position, the mandrel sleeve 1220 reaches the same axial position as the inner surface opening 1634. The annular clearance between the distal mandrel end 1210 (and more particularly the annular barb 1214) and the inner surface opening 1634 is smaller than the annular clearance between the distal mandrel end 1210 and the central passageway 1610 defined by the proximal body end 1614 and smaller than the thickness of the outer jacket 60 and the braided shield 58 of the cable 50. As a consequence, the braided shield 58 and the plastic jacket 60 are compressed between the outer surface 1222 (e.g., the annular barb 1214) of the mandrel sleeve 1220 and the inner surface opening 1634 to retain the cable 50 in the connector 10.

In the cable-installed position shown in FIG. 10, the annular barb 1214 may limit the axial egress of the outer jacket 60 of the cable past the annular lip 1638 and/or the annular shoulder 1630 of the body 16. For example, the annular barb 1214 may serve to resist the removal of the cable 50 from the connector 10 by providing an enhanced grip on the jacket 60, thereby inhibiting the easy removal of the cable 50 from the connector 10, thus assisting in preventing unintentional disengagement or loosening of the cable 50.

Once in the cable-installed position shown in FIG. 10, the nut 14 is frictionally disengaged from the mandrel 12, and is threadably tightenable onto a threaded male terminal (not shown). As described, the nut 14 may be freed from frictional engagement from the mandrel 12 by a slight reduction in the outer diameter $d_8$ near the proximal mandrel end 1212. The free-spinning rotational movement permitted between the nut 14, the body 16, and the mandrel 12 facilitates threaded engagement of the nut 14 to the threaded terminal (not shown).

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A connector for a coaxial cable having a central conductor, a dielectric insulator, a shield layer over the dielectric insulator, and an outer jacket over the shield layer, the connector comprising:

a mandrel comprising a mandrel sleeve insertable between the dielectric insulator and the shield layer, the mandrel sleeve defining a central bore to receive the dielectric insulator, the mandrel sleeve having an outer surface engageable with the coaxial cable beneath the shield layer;

a coupler having an annular shoulder extending radially inward from the coupler for retaining the mandrel and being adapted to operatively connect the connector to a mating connection; and a body matingly engaged with the coupler, the body defining a first inner bore proximate the coupler and having at least one of a substantially coextensive diameter or a convergent diameter extending from the end of the body proximate to the coupler to a second inner bore having a diameter at the location of the interface of the first and second inner bores that is smaller than the first inner bore;

wherein the mandrel sleeve and the second inner bore squeeze the outer jacket of the coaxial cable between the outer surface of the mandrel sleeve and second inner bore to affix the connector to the cable as the mandrel is slidably moved from a first position remote from the annular shoulder of the coupler to a second position proximal the annular shoulder of the coupler.

2. A connector as recited in claim 1, wherein the coupler further comprises an inwardly extending annular lip situated distal the annular shoulder, wherein the annular lip is matingly coupled to a corresponding annular lip disposed on an outer surface of the body to engage the body with the coupler.

3. A connector as recited in claim 1, further comprising an annular retaining sleeve coupled to an outer surface of the body.

4. A connector as recited in claim 3, wherein the annular retaining sleeve is coupled proximate the location of the second inner bore.

5. A connector as recited in claim 4, wherein the annular retaining sleeve prevents deformation of the body.

6. A connector as recited in claim 1, wherein the second inner bore further comprises an inwardly extending annular lip, and wherein the mandrel sleeve squeezes the outer jacket of the coaxial cable between the outer surface of the mandrel sleeve and inwardly extending annular lip.

7. A connector as recited in claim 1, wherein the first inner bore and the second inner bore are void of any undercuts.

8. A connector as recited in claim 1, wherein the mandrel includes a raised outer surface along at least a portion of the mandrel sleeve.

9. A connector as recited in claim 8, wherein the annular shoulder of the coupler interferencely engages the raised outer surface of the mandrel sleeve.

10. A connector as recited in claim 1, wherein the mandrel sleeve further comprises an annular barb, and wherein the annular barb squeezes the outer jacket between the mandrel sleeve and the second inner bore.

11. A method of manufacturing a connector for a coaxial cable having a central conductor, a dielectric insulator, a shield layer over the dielectric insulator, and an outer jacket over the at least one shield layer, the method comprising:

providing a mandrel comprising a mandrel sleeve insertable between the dielectric insulator and the shield layer, the mandrel sleeve defining a central bore to receive the dielectric insulator, the mandrel sleeve having an outer surface engageable with the coaxial cable beneath the shield layer;

coupling a coupler having an annular shoulder extending radially inward from the coupler to the mandrel;

pressingly engageing a body with the coupler, the body defining a first inner bore proximate the coupler and having at least one of a substantially coextensive diameter or a convergent diameter extending from the end of the body proximate to the coupler to a second inner bore having a diameter smaller than the first inner bore;

wherein the mandrel sleeve and the second inner bore squeeze the outer jacket of the coaxial cable between the outer surface of the mandrel sleeve and second inner bore to affix the connector to the cable as the mandrel is slidably moved from a first position remote from the annular shoulder of the coupler to a second position proximal the annular shoulder of the coupler.

12. A method as defined in claim 11, wherein the body is injection molded.

13. A method as defined in claim 12, wherein the first inner bore and the second inner bore are free of any undercuts.

14. A method as defined in claim 12, wherein the body is injection molded via a two core pin injection process including a first core pin forming the first inner bore and a second core pin forming at least a portion of the second inner bore.

15. A method as defined in claim 11, further comprising forming a raised outer surface along at least a portion of the mandrel sleeve for interferencely engaging the annular shoulder of the coupler.

16. A method as defined in claim 11, further comprising assembling a retaining sleeve over an outer surface of the body.

17. A method as defined in claim 11, wherein the coupler further comprises an inwardly extending annular lip situated distal the annular shoulder, and the outer surface of the body further comprises a corresponding outwardly extending annular lip, and wherein pressingly engaging the body with the coupler comprises pressing the inwardly extending annular lip of the coupler over the externally extending annular lip of the body.

* * * * *